US006522293B2

(12) United States Patent
Vail et al.

(10) Patent No.: US 6,522,293 B2
(45) Date of Patent: Feb. 18, 2003

(54) PHASED ARRAY ANTENNA HAVING EFFICIENT COMPENSATION DATA DISTRIBUTION AND RELATED METHODS

(75) Inventors: David Kenyon Vail, West Melbourne, FL (US); Frank J. Tabor, Melbourne, FL (US); Daniel P. Blom, Palm Bay, FL (US); Stephen S. Wilson, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/990,692

(22) Filed: Nov. 9, 2001

(65) Prior Publication Data

US 2002/0105463 A1 Aug. 8, 2002

Related U.S. Application Data

(60) Provisional application No. 60/255,007, filed on Dec. 12, 2000.

(51) Int. Cl.[7] ..... H01Q 3/22; H01Q 3/24; H01Q 3/26

(52) U.S. Cl. ..... 342/372; 342/157; 342/158

(58) Field of Search ..... 342/372, 157, 342/158

(56) References Cited

U.S. PATENT DOCUMENTS

| | | | | | |
|---|---|---|---|---|---|
| 4,573,050 | A | * | 2/1986 | Waters | 342/372 |
| 4,931,803 | A | | 6/1990 | Shimko | 342/371 |
| 4,980,691 | A | | 12/1990 | Rigg et al. | 342/372 |
| 4,994,814 | A | | 2/1991 | Aoki et al. | 342/372 |
| 4,996,532 | A | | 2/1991 | Kirimoto et al. | 342/81 |
| 5,008,680 | A | | 4/1991 | Willey et al. | 342/372 |
| 5,027,126 | A | | 6/1991 | Basehgi et al. | 342/372 |
| 5,072,228 | A | | 12/1991 | Kuwahara | 342/360 |
| 5,225,841 | A | | 7/1993 | Krikorian et al. | 342/204 |
| 5,231,405 | A | | 7/1993 | Riza | 342/375 |
| 5,243,274 | A | | 9/1993 | Kelsey et al. | 324/158 R |
| 5,283,587 | A | | 2/1994 | Hirshfield et al. | 342/372 |
| 5,307,073 | A | * | 4/1994 | Riza | 342/372 |
| 5,353,031 | A | | 10/1994 | Rathi | 342/372 |
| 5,493,255 | A | | 2/1996 | Murtojarvi | 330/296 |
| 5,559,519 | A | | 9/1996 | Fenner | 342/174 |
| 5,592,179 | A | | 1/1997 | Windyka | 342/372 |
| 5,655,841 | A | | 8/1997 | Storm | 374/183 |
| 5,680,141 | A | | 10/1997 | Didomenico et al. | 342/372 |
| 5,771,016 | A | | 6/1998 | Mullins et al. | 342/372 |
| 5,938,779 | A | | 8/1999 | Preston | 714/718 |
| 5,990,830 | A | | 11/1999 | Vail et al. | 342/368 |
| 5,995,740 | A | | 11/1999 | Johnson | 395/500.41 |
| 5,999,990 | A | | 12/1999 | Sharrit et al. | 718/8 |
| 6,011,512 | A | | 1/2000 | Cohen | 342/372 |
| 6,023,742 | A | | 2/2000 | Ebeling et al. | 710/107 |
| 6,157,681 | A | | 12/2000 | Daniel et al. | 375/298 |
| 6,163,220 | A | | 12/2000 | Schellenberg | 330/295 |
| 6,172,642 | B1 | | 1/2001 | DiDomenico et al. | 342/368 |

* cited by examiner

*Primary Examiner*—Theodore M. Blum
(74) *Attorney, Agent, or Firm*—Allen, Dyer, Doppelt, Milbrath & Gilchrist, P.A.

(57) ABSTRACT

A phased array antenna may include a substrate and at least one phased array antenna element carried thereby, at least one element controller for controlling the at least one phased array antenna element based upon desired compensation data, and a central controller for supplying to the at least one element controller a current value of a quick control parameter and a block of current compensation data. The block of current compensation data may be based upon a current value of a slow control parameter and a range of possible values for the quick control parameter. Further, the quick control parameter may vary more quickly than the slow control parameter. Additionally, the at least one element controller may determine the desired compensation data based upon the supplied block of current compensation data and the current value of the quick control parameter.

33 Claims, 4 Drawing Sheets

PHASED ARRAY ANTENNA HAVING EFFICIENT COMPENSATION DATA DISTRIBUTION AND RELATED METHODS

RELATED APPLICATION

This application is based upon prior filed copending provisional application Ser. No. 60/255,007 filed Dec. 12, 2000, the entire subject matter of which is incorporated herein by reference in its entirety.

FIELD OF THE INVENTION

The present invention relates to the field of communications, and, more particularly, to phased array antennas and related methods.

BACKGROUND OF THE INVENTION

Antenna systems are widely used in both ground based applications (e.g., cellular antennas) and airborne applications (e.g., airplane or satellite antennas). For example, so-called "smart" antenna systems, such as adaptive or phased array antennas, combine the outputs of multiple antenna elements with signal processing capabilities to transmit and/or receive communications signals (e.g., microwave signals, RF signals, etc.). As a result, such antenna systems can vary the transmission or reception pattern (i.e., "beam shaping" or "spoiling") or direction (i.e., "beam steering") of the communications signals in response to the signal environment to improve performance characteristics.

A typical phased array antenna may include, for example, one or more element controllers connected to a central controller. Among other functions, the element controllers process beam control commands generated by the central controller (e.g., beam steering signals and/or beam spoiling signals) and provide output control signals for each of the phased array antenna elements. More particularly, each antenna element may have a phase shifter, attenuator, delay generator, etc., and the output control signals from the element controller may be used to control a phase, attenuation, or delay thereof. Thus, the transmission or reception pattern may be varied, as noted above.

In such phased array antennas, it is quite often necessary to perform compensation for one or more varying control parameters. For example, temperature changes may have a significant impact on phase shifters, attenuators, or operating frequencies of the phased array antenna. This, in turn, may result in undesirable signal characteristics if proper compensation is not performed.

Two different prior art approaches are typically used to perform temperature compensation in phased array antennas. The first approach is to store temperature compensation look-up tables at each element controller. Each element controller then manages the temperature compensation for its associated antenna elements at all possible operating temperatures.

An example of a phased array antenna which utilizes element controller look-up tables is disclosed in U.S. Pat. No. 5,283,587 to Hirshfield et al. entitled "Active Transmit Phased Array Antenna." In this phased array antenna, a microprocessor element controller is used to control a group of antenna elements within the phased array antenna. The microprocessor element controller generates control voltages for controlling phase shifters and attenutators for the antenna elements. Further, because of potential temperature changes, a thermistor may be included to compensate the control voltages. The look-up tables are stored by the microprocessor element controller and are used to allow linearization of the control voltages.

One drawback of the above prior art approach is that the possible range of operating temperatures can often be quite large for a phased array antenna. For example, the operating temperature range of a phased array antenna on a satellite can vary quite widely depending upon whether the antenna is in sunlight or not. As a result, to implement the above prior art approach the element controllers will have to store a rather large set of compensation data to accommodate the entire possible operating temperature range. Thus, larger memory and addressing circuitry may be required in each element controller, which in turn may increase costs, space requirements, and power consumption.

The second prior art approach is to have the central controller perform essentially all of the temperature compensation and beam steering/spoiling processing. That is, each time the central processor sends new beam steering/spoiling commands to a particular element controller or implements a new operating frequency, the central controller also has to provide the appropriate temperature compensation. Yet, even though control parameters such as temperature may vary relatively slowly, other parameters such as frequency, for example, may vary relatively quickly. This is particularly true in phased array antennas which implement frequency hopping, for example. As such, this prior art approach may result in significant bandwidth limitations, particularly for antennas with large arrays and that have relatively fast frequency hopping or beam steering requirements.

SUMMARY OF THE INVENTION

In view of the foregoing background, it is therefore an object of the present invention to provide a phased array antenna having efficient compensation data distribution and related methods.

This and other objects, features, and advantages in accordance with the present invention are provided by a phased array antenna which may include a substrate and at least one phased array antenna element carried thereby, at least one element controller for controlling the at least one phased array antenna element based upon desired compensation data, and a central controller for supplying to the at least one element controller a current value of a quick control parameter and a block of current compensation data. The block of current compensation data may be based upon a current value of a slow control parameter and a range of possible values for the quick control parameter. Further, the quick control parameter may vary more quickly than the slow control parameter. Additionally, the at least one element controller may determine the desired compensation data based upon the supplied block of current compensation data and the current value of the quick control parameter.

More particularly, the central controller may supply the block of current compensation data to the at least one element controller based upon a change of the current value of the slow control parameter, and within a predetermined time thereof. Similarly, the central controller may supply the current value of the quick control parameter to the at least one element controller based upon a change in the quick control parameter, and also within a predetermined time thereof. Additionally, the central controller may supply the current value of the quick control parameter to the at least one element controller on a periodic basis.

Furthermore, the quick control parameter may be operating frequency, phase, and/or attenuation, and the slow control parameter may be temperature and/or beam shape, for example. Also, the at least one element controller may include a memory for storing the block of current compensation data. Plus, the central controller may generate beam control commands, and the at least one element controller may additionally include a processor for cooperating with the memory for controlling the at least one phased array antenna element based upon the beam control commands and the desired compensation data.

A method aspect of the invention is for using an element controller, such as the one described above, in a phased array antenna. The method may include supplying to the element controller a current value of a quick control parameter and a block of current compensation data. The block of current compensation data may be based upon a current value of a slow control parameter and a range of possible values for the quick control parameter. Further, the quick control parameter may vary more quickly than the slow control parameter. Additionally, the method may also include, at the element controller, determining desired compensation data based upon the supplied block of current compensation data and the current value of the quick control parameter.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
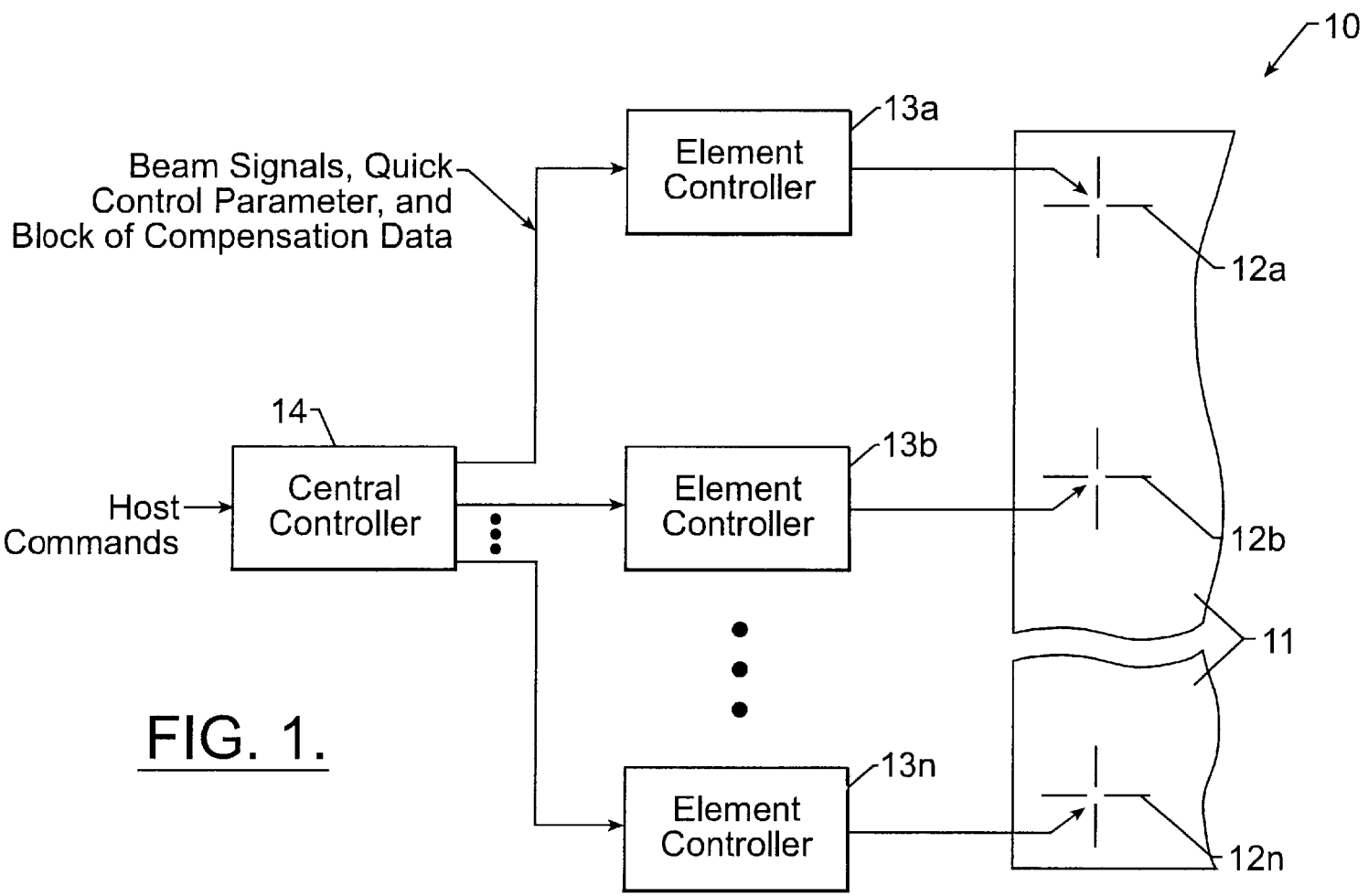
FIG. 1 is a schematic block diagram of a phased array antenna according to the present invention.

Referring initially to FIG. 1, a phased array antenna 10 according to the invention will now be described. The phased array antenna 10 may be used for ground, airborne, or spaceborne applications, as will be readily understood by those skilled in the art. As illustrated in FIG. 1, the phased array antenna 10 includes a substrate 11 and a plurality of phased array antenna elements 12*a*–12*n* carried thereby. As used herein, "substrate" refers to any surface, mechanized structure, etc., which is suitable for carrying a phased array antenna element, as will be appreciated by those of skill in the art. The phased array antenna 10 also illustratively includes a respective element controller 13*a*–13*n* for controlling each of the phased array antenna elements 12*a*–12*n*, as will be described further below. Of course, those skilled in the art will appreciate that in some embodiments a single element controller 13 may be used to control more than one of the antenna elements 12*a*–12*n*.

Figure 2:
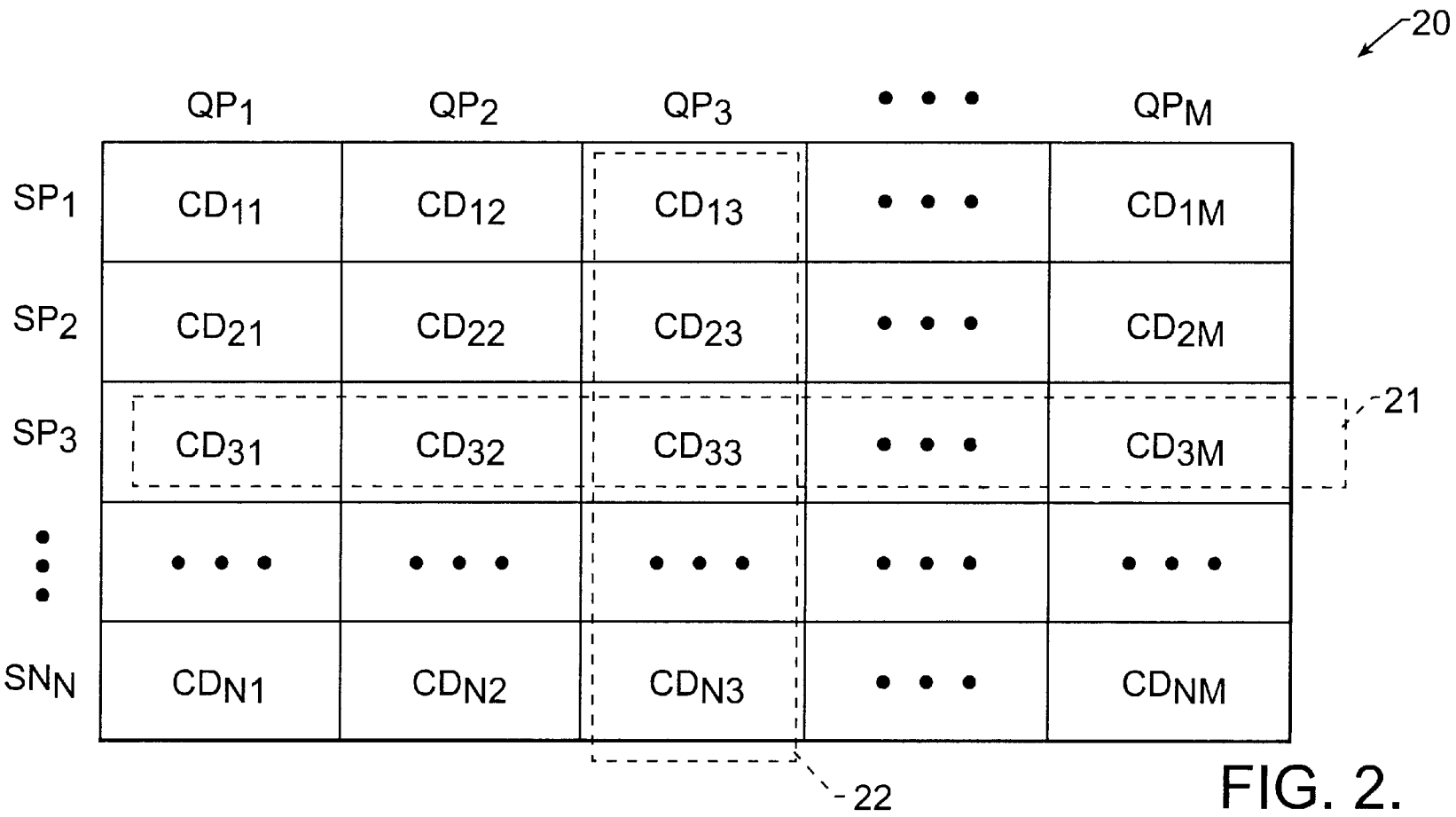
FIG. 2 is look-up table illustrating the determination of desired compensation data according to the present invention.

The phased array antenna 10 also illustratively includes a central controller 14 for supplying to the element controllers 13*a*–13*n* a current value of a quick control parameter and a block of current compensation data 21 (FIG. 2). The central controller 14 may include a microprocessor, for example, though other suitable circuitry known to those skilled in the art may also be used. By way of example, the quick control parameter may be one or more of frequency, phase, attenuation, beam angle, beam shape, or signal power.

The block of current compensation data 21 may be based upon a current value of a relatively slow control parameter, such as temperature or beam shape, for example, and a range of possible values for the quick control parameter. Stated in other terms, the quick control parameter is typically one that will vary more quickly than the slow control parameter. For example, in a frequency hopping phased array antenna, the operating frequency may be varied on a periodic basis, such as hundreds or even thousands of times per second. Yet, slow control parameters, such as temperature, may only change every few seconds, minutes, or even hours, for example. Also, the block of compensation data 21 may be "universal" data for use by all of the element controllers 13*a*–13*n*, or respective blocks of compensation data may be supplied for each element controller, as will be appreciated by those of skill in the art.

Figure 3:
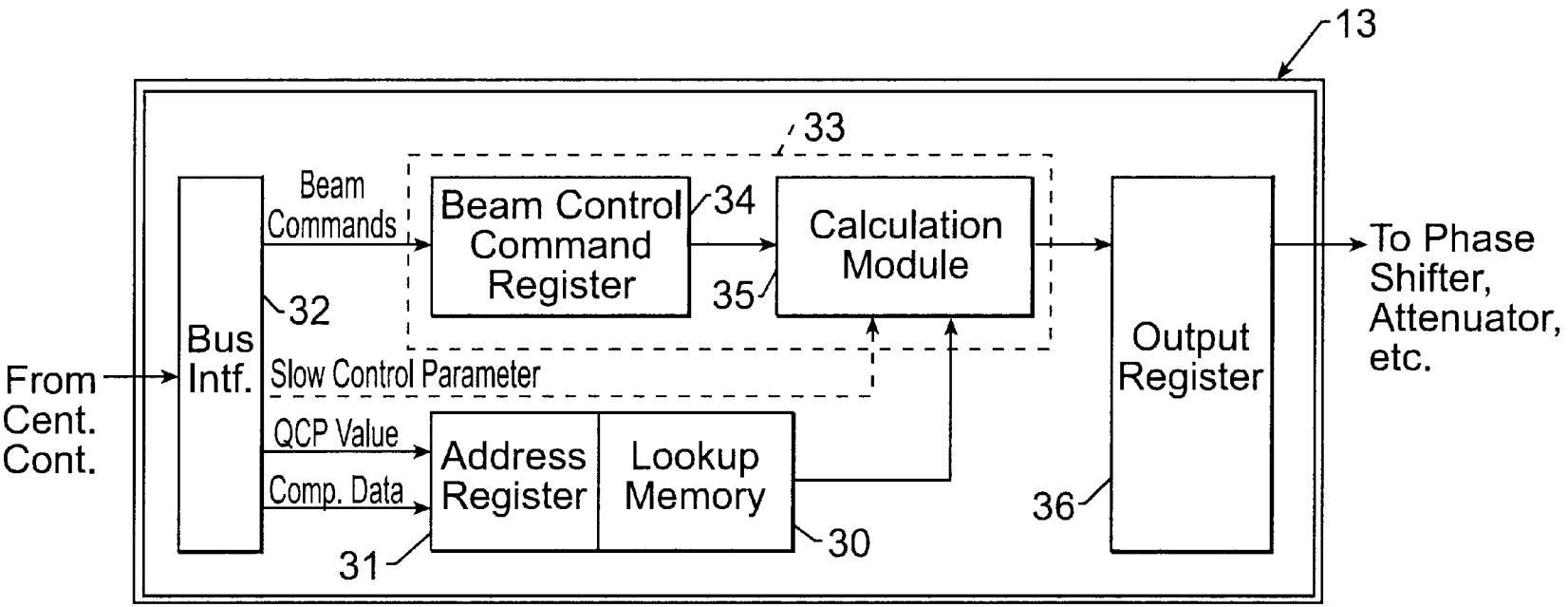
FIG. 3 is a more detailed schematic block diagram of an element controller of the phased array antenna of FIG. 1.

The block of current compensation data 20 may be more clearly understood with reference to the exemplary look-up table 20 shown in FIG. 3. For purposes of the example, it will be assumed that the phased array antenna 10 has a potential range of values $SP_1$–$SP_N$ for the slow control parameter (e.g., temperature), and a potential range of values $QP_1$–$QP_M$ for the quick control parameter (e.g., frequency). As noted above, the block of current compensation data 21 is based upon a current value of the slow control parameter, which in the present example is a temperature value $SP_3$. Accordingly, in the look-up table 20 the block of current compensation data 21 is a row of data corresponding to the value $SP_3$ for the entire range of frequency values $QP_1$–$QP_M$.

According to the present invention, the element controllers 13*a*–13*n* may advantageously determine desired compensation data based upon the supplied block of current compensation data 21 and the current value of the quick control parameter. Again turning to FIG. 2, if the current frequency value is $QP_3$ (corresponding to a column 22), the desired compensation data will be the intersection of the block (i.e., row) of current compensation data 21 and the column 22. That is, the compensation data will be the value $CD_{33}$.

Examples of some possible combinations of quick and slow compensation parameters are listed in Table 1, below. Of course, those of skill in the art will appreciate that other combinations are possible. For example, the central controller 14 may implement multiple quick control parameters (e.g., phase and frequency), and the block of current compensation data 21 may be based upon each of these the quick control parameters. Multiple slow control parameters may similarly be implemented.

TABLE 1

| | Quick Control Parameter | Slow Control Parameter |
|---|---|---|
| 1. | Frequency | Temperature |
| 2. | Frequency | Beam Shape |
| 3. | Phase | Temperature |
| 4. | Phase | Beam Shape |
| 5. | Attenuation | Temperature |

The central controller 14 may supply the current block (i.e., row) of compensation data 21 to the element controllers 13*a*–13*n* based upon a change of the current value of the slow control parameter, and within a predetermined time thereof. More particularly, since the slow control parameters vary relatively slowly, the compensation data does not need to be transmitted in "real time," so the predetermined time may therefore be relatively long (i.e., a few seconds). As a result, significant processing resources of the central controller 14 may be freed up since it does not have to determine new compensation data each time the current value of the quick control parameter changes, as in the second prior art approach discussed above. This may also equate to significant bandwidth savings, as will be appreciated by those of skill in the art.

The central controller 14 may also supply the current value of the quick control parameter to the element controllers 13*a*–13*n* based upon a change in the quick control parameter, and within a predetermined time thereof. That is, because the central controller 14 according to the present invention does not continually have to update the compensation data, the predetermined time for providing the quick control parameter may advantageously be kept relatively short without substantial increases in processing and/or bandwidth requirements. For example, the predetermined time period for providing the quick control parameter may be on the order of several milliseconds or even microseconds. This may be done on a periodic basis, such as in the case of frequency hopping, for example.

Turning now to FIG. 3, an exemplary element controller 13 of the phased array antenna 10 will now be described in further detail. The element controller 13 may include a memory 30 for storing the block of current compensation data 21 supplied by the central controller 14. More particularly, it will be appreciated that the entire look-up table 20 need only be stored at the central processor 14, and the memory 30 only needs to be large enough to store the block of current compensation data 21. As a result, the memory 30 of the present invention may be smaller than would otherwise be required in the first prior art approach discussed above, which may provide space, power, and cost savings over such an approach.

The block of current compensation data 21 may be written to the memory 30 via an address register 31 coupled to a bus interface 32 of the element controller 13. For example, one or more serial (or parallel) data busses may be used to connect the central controller 14 to the bus interface 32. The central controller 14 may also generate beam control commands (e.g., beam steering and/or spoiling commands) which are received by the bus interface 32. Further, the element controller 13 illustratively includes a processor 33 coupled to the bus interface 32. The processor 33 cooperates with the memory 30 for controlling a respective phased array antenna element (or elements) 12 based upon the beam control commands and the desired compensation data.

More particularly, the processor 33 may include one or more beam signal registers 34 for storing the beam control commands, and a calculation module 35. For example, the calculation module 35 may be an addition module for adding the beam control commands and the desired compensation data from the memory 30. Of course, the calculation module 35 may perform other mathematical operations (e.g., linear interpolation, polynomial calculation, etc.) as well, if desired. More complicated calculations may combine multiple parameters from the memory 30 together with the value of the slow control parameter. For example, a high resolution temperature value (e.g. 8 bits) might point to one of four sets of linear interpolation parameters (slope (m) and offset (B)). The calculation module 35 would compute mT+B= compensation value at a temperature T. The address of the desired compensation data to be provided to the calculation module 35 may be set by the address register 31 based upon the current quick control parameter supplied by the central controller 14, as illustratively shown.

Further, the element controller 13 may include one or more output registers 36 for storing and outputting control signals to respective phase shifters, attenuators, delay generators, etc. The element controller 13 may advantageously be implemented in an application specific integrated circuit (ASIC), for example, though other suitable devices, such as field-programmable gate array (FPGA), etc. may also be used.

Figure 4:
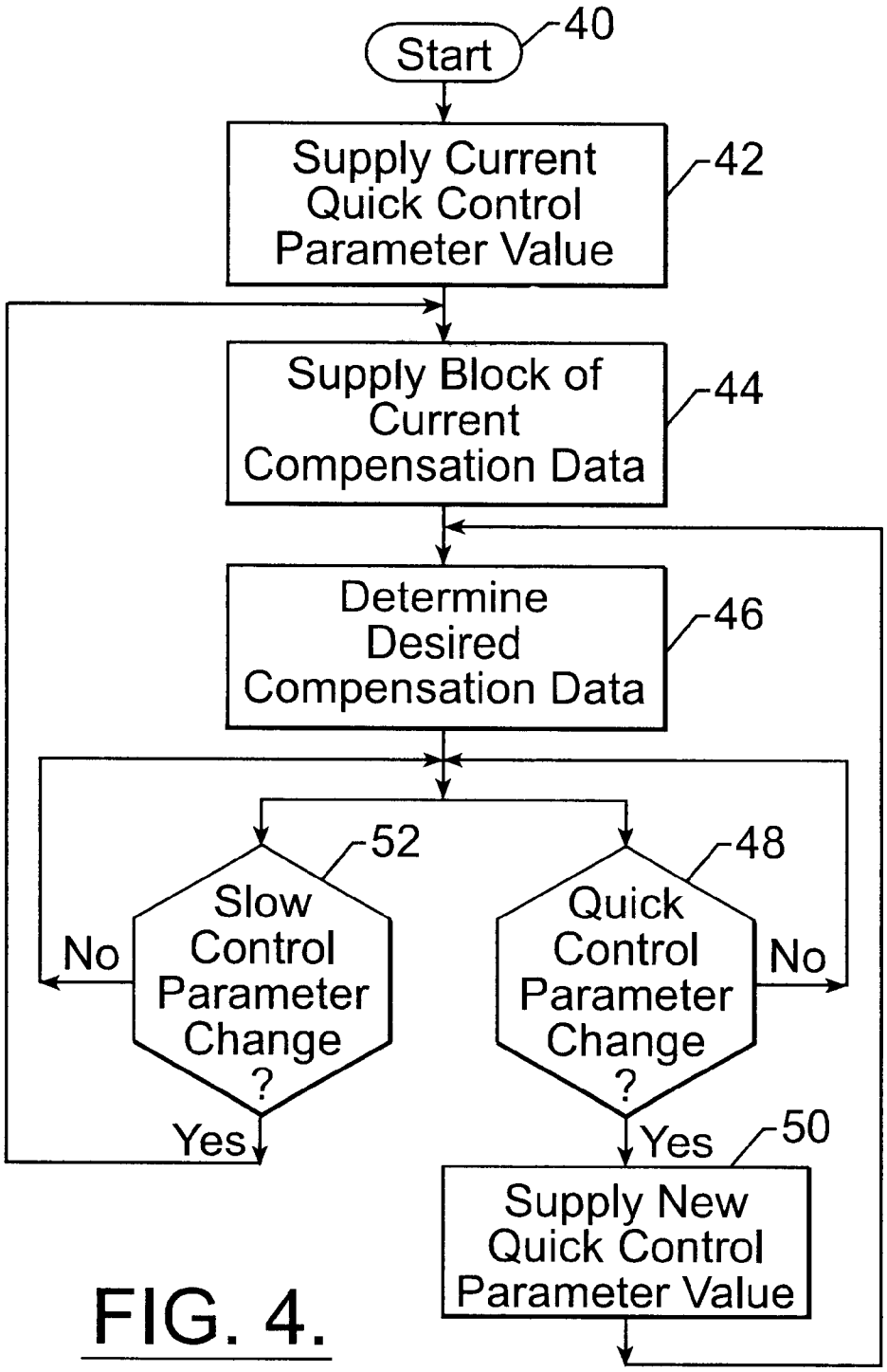
FIG. 4 is flow diagram illustrating a method of the present invention.

A method aspect of the invention for using the element controller 13 according to the invention will now be described with reference to the flow diagram of FIG. 4. The method begins (Block 40) with supplying to the element controller 13 a current value of a quick control parameter, at Block 42, and the block of current compensation data 21, at Block 44, as previously described above. The method may also include, at the element controller 13, determining the desired compensation data based upon the supplied block of current compensation data 21 and the current value of the quick control parameter, at Block 46.

Thereafter, upon the occurrence of a change in the current value of the quick control parameter (Block 48), the central controller 14 will supply the new current value of the quick control parameter to the element controller 13, at Block 50. Again, the quick control parameter is likely to be changing on a relatively fast basis (e.g., sub-millisecond). Further, upon the occurrence of a change in the current value of the slow control parameter, at Block 52, the central controller 14 will then supply a new block of compensation data 21 (Block 44) as described above. Of course, if neither the quick control parameter nor the slow control parameter changes, the element controller 13 may continue to provide the current output signals until such change(s) do occur, as illustratively shown.

In some embodiments, the processor 33 may include additional calculation capabilities to allow for interpolation between various compensation data values, as will be understood by those skilled in the art. For example, the processor 33 may perform linear interpolation, polynomial interpolation, etc., as previously described above. This may allow an even further decrease in memory size to be realized, for example, although there may be an associated increase in processor 33 complexity which may need to be considered. The particular implementation to be used will depend upon the intended application, though such implementations are within the capabilities of those skilled in the art based upon the above description.

Additionally, while the above invention has been discussed as being implemented with the central controller 14 and element controllers 13, those of skill in the art will appreciate that one or more sub-array controllers may also be included within the phased array antenna 10 according to the present invention. By way of example, a sub-array controller connected between the central controller 14 and a sub-group of element controllers 13 may store the look-up table 20 and transmit the appropriate block of compensation data 21 to respective element controllers 13. Alternately, such sub-array controllers may receive only the block of compensation data 21 from the central controller 14, and in turn supply the appropriate desired compensation data to respective element controllers 13. Further, a temperature compensation master data set could also be stored by a host and downloaded to the array only as needed, as will be appreciated by those skilled in the art. Other implementations may also be used, as will be appreciated by those skilled in the art.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna comprising:

a substrate and at least one phased array antenna element carried thereby;

at least one element controller for controlling said at least one phased array antenna element based upon desired compensation data; and a central controller for supplying to said at least one element controller a current value of a quick control parameter and a block of current compensation data, the block of current compensation data based upon a current value of a slow control parameter and a range of possible values for the quick control parameter, the quick control parameter varying more quickly than the slow control parameter;

said at least one element controller determining the desired compensation data based upon the supplied block of current compensation data and the current value of the quick control parameter.

2. The phased array antenna of claim 1 wherein said central controller supplies the block of current compensation data to said at least one element controller based upon a change of the current value of the slow control parameter.

3. The phased array antenna of claim 2 wherein said central controller supplies the block of current compensation data to said at least one element controller within a predetermined time of the change in the current value of the slow control parameter.

4. The phased array antenna of claim 1 wherein said central controller supplies the current value of the quick control parameter to said at least one element controller based upon a change in the quick control parameter.

5. The phased array antenna of claim 4 wherein said central controller supplies the current value of the quick control parameter to said at least one element controller within a predetermined time of the change in the quick control parameter.

6. The phased array antenna of claim 1 wherein said central controller supplies the current value of the quick control parameter to said at least one element controller on a periodic basis.

7. The phased array antenna of claim 1 wherein the quick control parameter comprises operating frequency.

8. The phased array antenna of claim 7 wherein the slow control parameter comprises temperature.

9. The phased array antenna of claim 7 wherein the slow control parameter comprises beam shape.

10. The phased array antenna of claim 1 wherein the quick control parameter comprises phase.

11. The phased array antenna of claim 10 wherein the slow control parameter comprises temperature.

12. The phased array antenna of claim 10 wherein the slow control parameter comprises beam shape.

13. The phased array antenna of claim 1 wherein the quick control parameter comprises attenuation.

14. The phased array antenna of claim 13 wherein the slow control parameter comprises temperature.

15. The phased array antenna of claim 1 wherein said at least one element controller comprises a memory for storing the block of current compensation data.

16. The phased array antenna of claim 15 wherein said central controller generates beam control commands; and wherein said at least one element controller further comprises a processor for cooperating with said memory for controlling said at least one phased array antenna element based upon the beam control commands and the desired compensation data.

17. A phased array antenna comprising:

a substrate and a plurality of phased array antenna elements carried thereby;

a respective element controller for controlling each of said phased array antenna elements based upon desired compensation data; and a central controller for supplying to each of said element controllers a current value of a quick control parameter and a block of current compensation data, the block of current compensation data based upon a current value of a slow control parameter and a range of possible values for the quick control parameter, the quick control parameter varying more quickly than the slow control parameter;

each element controller determining the desired compensation data based upon the supplied block of current compensation data and the current value of the quick control parameter;

said central controller supplying the block of current compensation data to each element controller based upon a change of the current value of the slow control parameter.

18. The phased array antenna of claim 17 wherein said central controller supplies the block of current compensation data to each element controller within a predetermined time of the change in the current value of the slow control parameter.

19. The phased array antenna of claim 17 wherein said central controller supplies the current value of the quick control parameter to each element controller based upon a change in the quick control parameter.

20. The phased array antenna of claim 19 wherein said central controller supplies the current value of the quick control parameter to each element controller within a predetermined time of the change in the quick control parameter.

21. The phased array antenna of claim 17 wherein said central controller supplies the current value of the quick control parameter to each element controller on a periodic basis.

22. The phased array antenna of claim 17 wherein the quick control parameter comprises at least one of operating frequency, phase, and attenuation.

23. The phased array antenna of claim 17 wherein the slow control parameter comprises at least one of temperature and beam shape.

24. The phased array antenna of claim 17 wherein each element controller comprises a memory for storing the block of current compensation data.

25. The phased array antenna of claim 24 wherein said central controller further generates beam control commands; and wherein each element controller further comprises a processor for cooperating with said memory for controlling a respective phased array antenna element based upon the beam control commands and the desired compensation data.

26. A method for using an element controller in a phased array antenna comprising:

supplying to the element controller a current value of a quick control parameter and a block of current compensation data, the block of current compensation data based upon a current value of a slow control parameter and a range of possible values for the quick control parameter, the quick control parameter varying more quickly than the slow control parameter; and at the element controller, determining desired compensation data based upon the supplied block of current compensation data and the current value of the quick control parameter.

27. The method of claim 26 wherein supplying the block of current compensation data to the element controller comprises supplying the block of current compensation data to the element controller based upon a change of the current value of the slow control parameter.

28. The method of claim 27 wherein supplying the block of current compensation data to the element controller comprises supplying the block of current compensation data to the element controller within a predetermined time of the change in the current value of the slow control parameter.

29. The method of claim 26 wherein supplying the current value of the quick control parameter to the element controller comprises supplying the current value of the quick control parameter to the element controller based upon a change in the quick control parameter.

30. The method of claim 29 wherein supplying the current value of the quick control parameter to the element controller comprises supplying the current value of the quick control parameter to the element controller within a predetermined time of the change in the quick control parameter.

31. The method of claim 26 wherein supplying the current value of the quick control parameter to the element controller comprises supplying the current value of the quick control parameter to the element controller on a periodic basis.

32. The method of claim 26 wherein the quick control parameter comprises at least one of operating frequency, phase, and attenuation.

33. The method of claim 26 wherein the slow control parameter comprises at least one of temperature and beam shape.

* * * * *